US006408274B2

(12) United States Patent
Tedd

(10) Patent No.: US 6,408,274 B2
(45) Date of Patent: Jun. 18, 2002

(54) METHOD AND APPARATUS FOR SYNCHRONIZING A COMPUTER-ANIMATED MODEL WITH AN AUDIO WAVE OUTPUT

(75) Inventor: Douglas N. Tedd, Eindhoven (NL)

(73) Assignee: Koninklijke Philips Electronics N.V., New York, NY (US)

( * ) Notice: Subject to any disclaimer, the term of this patent is extended or adjusted under 35 U.S.C. 154(b) by 93 days.

(21) Appl. No.: 09/145,095

(22) Filed: Sep. 1, 1998

(30) Foreign Application Priority Data

Sep. 1, 1997 (EP) ..... 97202672

(51) Int. Cl.[7] ..... G10L 21/00
(52) U.S. Cl. ..... 704/278; 704/270
(58) Field of Search ..... 704/260, 270, 704/276, 278; 345/473, 472, 949

(56) References Cited

U.S. PATENT DOCUMENTS 4,177,589 A * 12/1979 Villa ..... 40/457
4,949,327 A * 8/1990 Forsse et al. ..... 369/58
5,074,821 A * 12/1991 McKeefery et al. ..... 446/299
5,111,409 A * 5/1992 Gasper et al. ..... 704/278
5,149,104 A * 9/1992 Edelstein ..... 461/31
5,278,943 A * 1/1994 Gasper et al. ..... 704/278
5,426,460 A 6/1995 Erving et al. ..... 348/14
5,613,056 A 3/1997 Gasper et al. ..... 395/173
5,969,721 A * 10/1999 Chen et al. ..... 345/419
6,031,539 A * 2/2000 Kang et al. ..... 345/419

FOREIGN PATENT DOCUMENTS

EP 0710929 A2 5/1996 ..... G06T/15/70

* cited by examiner

*Primary Examiner*—Richemond Dorvil
*Assistant Examiner*—Michael N-Opsasnick
(74) *Attorney, Agent, or Firm*—Russell Gross

(57) ABSTRACT

A computer-animated image of a video model is stored for synchronized outputting with an audio wave. When receiving the audio wave representation, the model is dynamically varied under control of the audio wave, and outputted together with the audio wave. In particular, an image parameter is associated to the model. By measuring an actual audio wave amplitude, and mapping the amplitude in a multivalued or analog manner on the image parameter the outputting is synchronized.

9 Claims, 1 Drawing Sheet

METHOD AND APPARATUS FOR SYNCHRONIZING A COMPUTER-ANIMATED MODEL WITH AN AUDIO WAVE OUTPUT

BACKGROUND OF THE INVENTION

Certain systems require animating a computer-generated graphic model together with outputting an audio wave pattern to create the impression that the model is actually speaking the audio that is output. Such a method has been disclosed in U.S. Pat. No. 5,613,056. The reference utilizes complex procedures that generally need prerecorded speech. The present invention intends to use simpler procedures, that inter alia should allow to operate in real-time with non-prerecorded speech, as well as in various play-back modes.

SUMMARY TO THE INVENTION

In consequence, amongst other things, it is an object of the present invention to provide a straightforward operation that necessitates only little immediate interaction for controlling the image, and would give a quite natural impression to the user. The inventor has found that simply opening and closing the mouth of an image figure does not suggest effective speaking, and moreover, that it is also necessary to ensure that the visual representation is kept in as close synchronization as possible with the audio being output (lipsync) because even small differences between audio and animated visuals are detectable by a human person. "Multivalued" here may mean either analog or multivalued digital. If audio is received instantaneously, its reproduction may be offset by something like 0.1 second for allowing an apparatus to amend the video representation.

The invention also relates to a device arranged for implementing the method according to the invention. Further advantageous aspects of the invention are recited in dependent claims.

BRIEF DESCRIPTION OF THE DRAWING

These and further aspects and advantages of the invention will be discussed more in detail hereinafter with reference to the disclosure of preferred embodiments, and in particular with reference to the appended Figures that show.

DETAILED DESCRIPTION OF PREFERRED EMBODIMENTS

Figure 1:
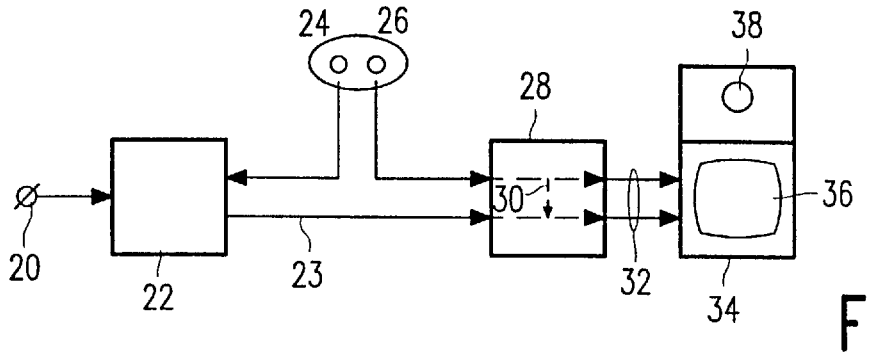
FIG. 1, a diagram of a device according to the invention.

FIG. 1 shows a diagram of a device according to the invention. On input 20, the device receives information of an image. This information may represent still images, or images that may move around, such as walk, fly, or execute other characteristic motions. The images may be executed in bit map, in line-drawing, or in another useful representation. In particular, one or more parameters of the image or images may be expressed in terms of an associated analog or multi-valued digital quantity. Block 22 may store the images for subsequent addressing, in that each image has some identifier or other distinctive qualification viz a viz the system. Input 26 receives an appropriate audio wave representation. In an elementary case, this may be speech for representation over loudspeaker 38. In another situation, the speech may be coded according to some standard scheme, such as LPC. If applicable, input 24 receives some identifier for the visual display, such as for selecting among a plurality of person images, or some other, higher level selecting mechanism, for selecting among a plurality of movement patterns or otherwise. The image description is thus presented on output 23. In block 28, the actual audio wave amplitude is measured, and its value along interconnection 30 is mapped in a multivalued manner or analog manner on one or more associated image parameters for synchronized outputting. On output 32 both the audio and the image information are presented in mutual synchronism for displaying on monitor 36 and audio rendering on loudspeaker 38.

Figure 2:
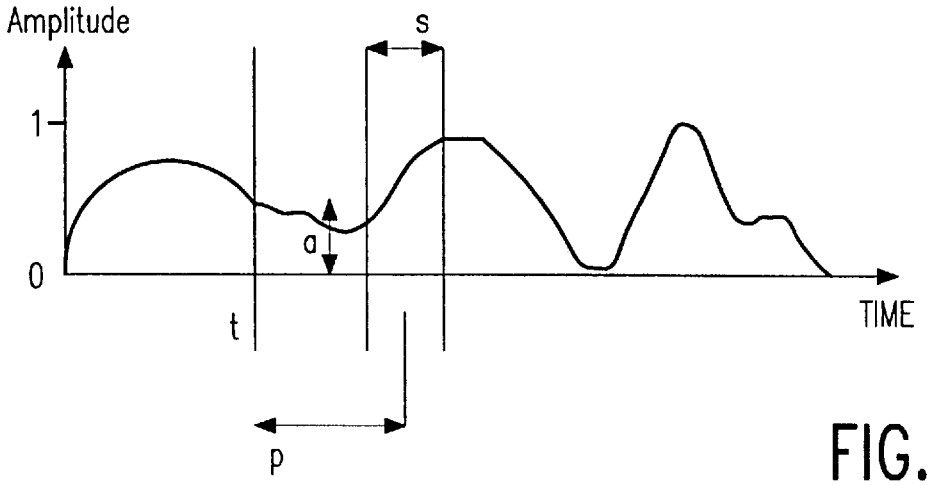
FIG. 2, a sample piece of audio wave envelope.

FIG. 2 shows a sample piece of audio wave data envelope that is output. The vertical axis represents the wave amplitude and the horizontal axis represents time. The time period s is the sample time period over which the wave amplitude is measured and averaged. In practice, this period is often somewhat longer than the actual pitch period, and may be in the range of 0.01 to 0.1 of a second. This averaged amplitude a is scaled by a scaling factor f and used to animate the position of an object. The scaling factor allows a further control mechanism. Alternatively, the factor may depend on the "person" that actually speaks, or on various other aspects. For example, a person while mumbling may get a smaller mouth opening.

To ensure that the object is in synchronism with the instant in time on which the sampled audio wave is reproduced, a prediction time p is used to offset the sample period from the current time t. This prediction time can make allowances for the time it takes the apparatus to redraw the graphical object with the new object position.

Figure 3:
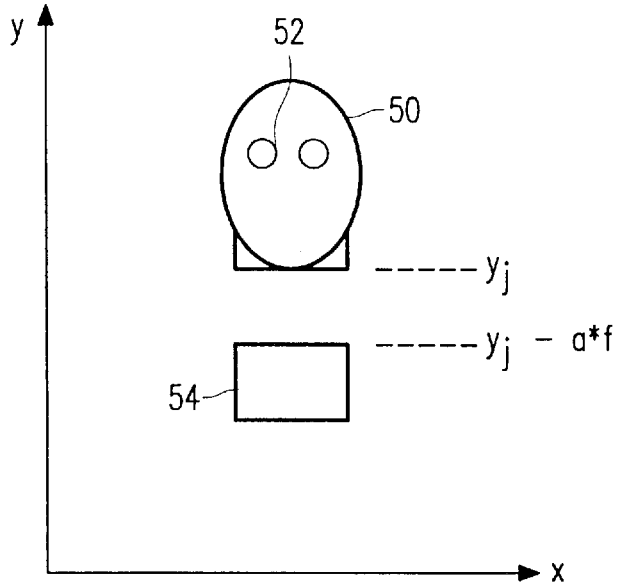
FIG. 3, an exemplary computer-produced graphical model.

FIG. 3 shows an exemplary computer-produced graphical model, in this case a frontal image of an elementary computer-generated human head, that has been simplified into an elliptical head outline 50, two circular eyes 52, and a lower jaw section 54. The model is parametrized through an analog or multivalued digital distance a*f between the jaw section and the position of the remaining part of the head proper, that is expressed as ($y_j$−a*f). The opening distance of the lower jaw is connected to the scaled (a*f) output amplitude of the audio being played. In another embodiment this may be an opening angle of the jaw, or another location parameter. The audio may contain voiced and unvoiced intervals, and may also have louder and softer intervals. This causes the jaw to open wider as the wave amplitude increases and to correspondly close as the wave amplitude decreases. The amount of movement of the speaking mouth varies with the speech reproduced, thus giving the impression of talking.

In addition, it is also possible to animate other properties such as the x- and z-coordinates of objects, as well as object rotation and scaling. The technique can also be applied to other visualizations than solely speech reproduction, such as music. The scaling factor f allows usage of the method with models of various different sizes. Further, the scaling factor may be set to different levels of "speaking clarity". If the model is mumbling, its mouth should move relatively little. If the model speaks with emphasis, also the mouth movement should be more accentuated.

The invention may be used in various applications, such as for a user enquiry system, for a public address system, and for other systems wherein the artistic level of the representation is relatively unimportant. The method may be executed in a one-sided system, where only the system outputs speech. Alternatively, a bidirectional dialogue may be executed wherein also speech recognition is applied to voice inputs from a user person. Various other aspects or parameters of the image can be influenced by the actual audio amplitude. For example, the colour of a face could redden at higher audio amplitude, hairs may raise or ears may flap, such as when the image reacts by voice raising on an uncommon user reaction. Further, the time constant of various reactions by the image need not be uniform, although mouth opening should always be largely instantaneous.

What is claimed is:

1. A method for synchronizing a computer-animated model to an audio wave output, said method comprising the steps of storing a computer-animated image of said model, receiving an audio wave representation, dynamically varying said model under control of said audio wave, and outputting said dynamically varied model together with said audio wave, associating to said model an image parameter, measuring an audio wave amplitude, scaling the audio wave amplitude according to a scaling factor to produce a scaled amplitude and mapping said scaled amplitude on said image parameter for synchronized outputting.

2. A method as claimed in claim 1, wherein said audio is speech.

3. A method as claimed in claim 1, wherein said audio is humanoid speech.

4. A method as claimed in claim 1, wherein said image parameter is a location parameter.

5. A method as claimed in claim 1, wherein said image parameter is a size parameter of a humanoid's mouth.

6. A method as claimed in claim 1, wherein said image parameter is one of a colour, a facial expression, or a body motion.

7. A method as claimed in claim 1, wherein said mapping is associated to a non-uniform time constant.

8. A method as claimed in claim 1 arranged for being executed in real-time.

9. A method as claimed in claim 1, furthermore allowing the outputting of the audio wave a time offset to amend the video representation.

* * * * *